US008806796B1

(12) United States Patent
Clifton

(10) Patent No.: US 8,806,796 B1
(45) Date of Patent: Aug. 19, 2014

(54) CAM LEVER MOUNT

(71) Applicant: Norman E. Clifton, Jacksonville, FL (US)

(72) Inventor: Norman E. Clifton, Jacksonville, FL (US)

(73) Assignee: Prezine, LLC, Jacksonville, FL (US)

( * ) Notice: Subject to any disclaimer, the term of this patent is extended or adjusted under 35 U.S.C. 154(b) by 0 days.

(21) Appl. No.: 13/774,649

(22) Filed: Feb. 22, 2013

(51) Int. Cl.
*F41C 27/00* (2006.01)

(52) U.S. Cl.
CPC ..... *F41C 27/00* (2013.01)
USPC ..... 42/90; 42/127; 42/148

(58) Field of Classification Search
USPC ..... 42/90, 124–127, 111, 148; 248/229.21, 248/229.22
See application file for complete search history.

(56) References Cited

U.S. PATENT DOCUMENTS

| | | | | |
|---|---|---|---|---|
| 2,351,386 | A | 6/1944 | Zucker | |
| 2,439,483 | A | 4/1948 | Merriman | |
| 2,824,504 | A | 2/1958 | Bethmann | |
| 2,840,334 | A | 6/1958 | Cauthen | |
| 3,006,052 | A | 10/1961 | Stickney | |
| 3,324,558 | A | 6/1967 | Hart | |
| 3,356,325 | A | 12/1967 | Schnase | |
| 3,549,113 | A | 12/1970 | Pagliuso | |
| 3,612,462 | A | 10/1971 | Mooney | |
| 3,765,061 | A | 10/1973 | Nash | |
| 4,525,052 | A | 6/1985 | Kosugi | |
| 4,845,871 | A | 7/1989 | Swan | |
| 4,929,973 | A | 5/1990 | Nakatani | |
| 5,155,915 | A * | 10/1992 | Repa | 42/127 |
| 5,230,490 | A | 7/1993 | Sloop | |
| 5,333,023 | A | 7/1994 | Oxford | |
| 5,429,332 | A | 7/1995 | Ishikawa | |
| 5,680,725 | A | 10/1997 | Bell | |
| 5,775,352 | A | 7/1998 | Obitts | |
| 5,870,641 | A | 2/1999 | Chrosziel | |
| 6,164,843 | A | 12/2000 | Battocchio | |
| 6,637,144 | B2 * | 10/2003 | Nebarez et al. | 42/120 |
| 6,712,322 | B2 | 3/2004 | Nakatani | |
| 6,739,559 | B2 | 5/2004 | Nakatani | |
| 6,773,172 | B1 * | 8/2004 | Johnson et al. | 396/428 |
| 6,922,934 | B1 | 8/2005 | Huan | |
| 6,931,778 | B1 * | 8/2005 | Nelson et al. | 42/120 |
| 7,077,582 | B2 * | 7/2006 | Johnson | 396/428 |
| 7,107,716 | B1 * | 9/2006 | Liao | 42/108 |
| 7,272,904 | B2 | 9/2007 | Larue | |
| 7,562,485 | B2 * | 7/2009 | Newhall et al. | 42/127 |
| 7,572,074 | B2 | 8/2009 | Teratani | |
| 7,588,376 | B2 | 9/2009 | Friedrich | |
| 7,685,759 | B2 * | 3/2010 | Teetzel | 42/127 |
| 7,712,242 | B2 * | 5/2010 | Matthews et al. | 42/90 |
| 7,775,201 | B2 | 8/2010 | Cooper | |

(Continued)

*Primary Examiner* — Jonathan C Weber
(74) *Attorney, Agent, or Firm* — Brian S. Steinberger; Law Offices of Brian S. Steinberger, P.A.

(57) ABSTRACT

Cam lever mounts, devices, systems and methods with pivotable/foldable levers for attaching grips, sights, flashlights to picatinny rails on firearms. A moveable mount having one side with an upper and lower shroud covers has a space therebetween. A lever pivotally attached in the space moves from open to closed positions with substantial portions of the lever protected by the upper and lower shroud covers. The lever pivoting end can be attached to one end of an elongated member with other end attached to a stationary mount so that rotating the lever from open to closed draws the moveable mount toward the stationary mount. Inner sides of the moveable and stationary mounts can have clamp edges facing one another which can attach and detach to the picatinny rails.

19 Claims, 15 Drawing Sheets

(56) References Cited

U.S. PATENT DOCUMENTS

| | | | | |
|---|---|---|---|---|
| 7,823,316 | B2 | 11/2010 | Storch | |
| 7,828,256 | B2 | 11/2010 | Speggiorin | |
| 7,841,784 | B2 | 11/2010 | Elias | |
| 7,905,045 | B1 | 3/2011 | Swan | |
| D637,260 | S | 5/2011 | Swan | |
| D638,089 | S | 5/2011 | Ding | |
| 7,941,960 | B2 * | 5/2011 | Matthews et al. | 42/90 |
| 7,946,771 | B2 | 5/2011 | Boneschanscher | |
| 8,112,933 | B1 | 2/2012 | Swan | |
| 8,127,484 | B2 * | 3/2012 | Matthews et al. | 42/90 |
| D672,839 | S | 12/2012 | Ding | |
| 8,336,247 | B2 * | 12/2012 | Haering | 42/127 |
| 8,393,105 | B1 * | 3/2013 | Thummel | 42/90 |
| 8,397,421 | B2 * | 3/2013 | Ding et al. | 42/124 |
| 8,438,773 | B2 | 5/2013 | Carlson | |
| 8,438,965 | B2 * | 5/2013 | Collin et al. | 89/125 |
| 8,567,105 | B1 * | 10/2013 | Bobro | 42/90 |
| 8,578,647 | B2 * | 11/2013 | Storch et al. | 42/124 |
| 2002/0162267 | A1 * | 11/2002 | Nelson et al. | 42/120 |
| 2003/0218108 | A1 | 11/2003 | Werner | |
| 2005/0041966 | A1 * | 2/2005 | Johnson | 396/428 |
| 2006/0117636 | A1 * | 6/2006 | Newhall et al. | 42/124 |
| 2007/0068058 | A1 | 3/2007 | Remo | |
| 2008/0092421 | A1 * | 4/2008 | Beckmann | 42/90 |
| 2010/0162611 | A1 | 7/2010 | Samson | |
| 2011/0067287 | A1 * | 3/2011 | Collin et al. | 42/119 |
| 2011/0076095 | A1 | 3/2011 | Storch | |
| 2011/0146128 | A1 * | 6/2011 | Haering | 42/90 |
| 2011/0173866 | A1 * | 7/2011 | Matthews et al. | 42/90 |
| 2011/0247255 | A1 * | 10/2011 | Ding et al. | 42/90 |
| 2012/0102853 | A1 | 5/2012 | Rizzo | |
| 2012/0167438 | A1 * | 7/2012 | Daniel et al. | 42/90 |
| 2012/0198745 | A1 * | 8/2012 | Riley et al. | 42/90 |
| 2013/0134286 | A1 * | 5/2013 | Yan | 248/544 |
| 2013/0318848 | A1 * | 12/2013 | Kincel | 42/90 |
| 2013/0318849 | A1 * | 12/2013 | Kincel | 42/90 |

* cited by examiner

CAM LEVER MOUNT

CROSS REFERENCE TO RELATED APPLICATIONS

This invention claims the benefit of priority to U.S. Design patent application Ser. No. 29/440,508 filed Dec. 21, 2012, the entire disclosure of which is incorporated by reference.

FIELD OF INVENTION

This invention relates to firearms, and in particular to cam lever mounts, devices, systems and methods having pivotable/foldable levers for attaching accessories such as grips, stands, sights, flashlights and other accessories to picatinny rails on firearms.

BACKGROUND AND PRIOR ART

Mounting brackets having clamps with one fixed side clamp and an opposite facing moveable clamp have been used over the years to mount accessories, such as flashlights, sights and fore grips to existing picatinny rails on firearms. Many of these types of devices use rotatable screw type fasteners and/or use pivotable/foldable levers to move the move a moveable clamp portion against a fixed and stationary clamp portion so that the clamp portions clamp about exterior sides of the existing picatinny rails. However, both the screwable fasteners and the pivotable levers have problems.

Screw type fasteners for the clamp brackets often have knob head or lever head or thumb screw head which are rotated to move a moveable clamp portion toward a fixed clamp portion. See for Example, U.S. Pat. No. 3,612,462 to Mooney; U.S. Pat. No. 5,680,725 to Bell and U.S. Pat. No. 6,922,934 to Huan. However, there are problems with these types of clamp brackets.

The enlarged knob or lever head often sticks out with a high profile position and can catch and become snagged by the user. The snag can potentially loosen the screw connection by unraveling the threads of the screw by rubbing against the screw head which can result in an inadvertent release of the clamp bracket and the accessory from the firearm. Additionally, the loosened screw can eventually fall off and become lost rendering the clamp bracket useless until another screw fastener is used.

Additionally, the screw fasteners are not easy for the user to install the clamp bracket or to remove the clamp bracket. Having to continuously rotate a screw fastener can be tedious and time consuming and would not be desirable for users of the weapons that use the clamp brackets. For example, law enforcement and/or snipers in the field generally need to quickly and efficiently attach and detach their accessories such as sights, flashlights and fore grips from their weapons. Any unnecessary time delays to attach or detach such accessories to weapons can be dangerous to the user.

Pivotable/foldable levers have also been used over the years with clamp brackets that mount accessories such as flashlights, sights and fore grips to picatinny rails on firearms and/or to clamp photographic equipment such as cameras to stands. A user will generally pivot or fold the levers to move a moveable clamp portion toward a fixed clamp portion. See for example, U.S. Pat. No. 6,773,172 to Johnson et al.; U.S. Pat. No. 7,272,904 to Larue; U.S. Pat. No. 7,823,316 to Storch; D637,260 to Swan; and U.S. Pat. No. 8,112,933 to Swan and U.S. Published Patent Application 2011/0076095 to Storch et al. However, there are problems with these types of clamp brackets.

Many of the pivotable/foldable levers have the tips or free ends that can stick out up to being perpendicular from the sides of the clamp brackets when the bracket is in a closed position. Even with a low profile positioned lever, the levers can snag which can result in an inadvertent release of the clamp bracket and the accessory from the firearm.

Attempts over the years have been made to prevent the snag issue from causing an inadvertent release, such as those shown and described by Storch '095 and Swan '933.

Storch '095 requires a separate lock that must be disengaged so that the lever can pivot from a closed position to an open position. Extra parts such as springs and ball bearings are used to hold the lever in a locked position. Another version has a depressible button that must be separately actuated to allow the lever to move to an open position. Swan '933 has an extra spring biased depressible locking lever that must be separately actuated for preventing a main type lever from being inadvertently released.

Both Storch '095 and Swan '933 require expensive extra parts that would raise the cost of the traditional clamp bracket. Also, the more moveable parts and the greater the complexity of these clamp brackets, the greater the chance of failure that can occur over time. Additionally, both references can cause a delay of releasing the main lever which is not a desirable effect when using accessories on weapons.

Also, the most of the side edges of the main levers in both the Storch '095 and Swan '933 references are exposed in the clamp bracket lock position. An inadvertent release is still possible if exposed side edges of the lever become snagged.

An additional problem with most prior art pivotable/foldable levers and their assemblies is that most of the parts require metal materials that require machined and/or cast metal parts that can be expensive and labor intensive and cost and time.

Additionally, the exposure of the sides and tip ends of the pivotable/foldable levers having exposed levers in closed positions can have other problems. Dropping the clamp bracket on the lever portion, and/or having an object strike against the lever portion of the clamp bracket can result in damage to the clamp bracket overtime, which can require costly and time consuming repairs or full replacement of the clamp bracket. Thus, the need exists for solutions to the above problems with the prior art.

SUMMARY OF THE INVENTION

A primary objective of the invention is to provide cam lever mounts, devices, systems and methods having pivotable/foldable levers for attaching accessories such as grips, stands, sights, flashlights and the like, to picatinny rails on firearms, having levers with surface edges and tips that snag causing an advertent release of the accessories.

A secondary objective of the invention is to provide cam lever mounts, devices, systems and methods having pivotable/foldable levers for attaching accessories such as grips, stands, sights, flashlights and the like to picatinny rails on firearms, having levers that are shrouded and protected from damage in the closed locking position.

A third objective of the invention is to provide cam lever mounts, devices, systems and methods having pivotable/foldable levers for attaching accessories such as grips, stands, sights, flashlights and the like, to picatinny rails on firearms, having levers that do not require extra expensive parts to lock the lever in place.

A fourth objective of the invention is to provide cam lever mounts, devices, systems and methods having pivotable/foldable levers for attaching accessories such as grips, stands, sights, flashlights and the like, to picatinny rails on firearms, having levers that do not require separate actuating parts and extra time to release the levers.

A fifth objective of the invention is to provide cam lever mounts, devices, systems and methods having pivotable/foldable levers for attaching accessories such as grips, stands, sights, flashlights and the like, to picatinny rails on firearms, having levers with a low profile that do not stick out when in a closed locking position.

A sixth objective of the invention is to provide cam lever mounts, devices, systems and methods having pivotable/foldable levers for attaching accessories such as grips, stands, sights, flashlights and the like, to picatinny rails on firearms, having parts that can be entirely formed from injection molded polymer and not require metal, and the like, and do not require machined metal and cast metal.

An embodiment of the cam lock assembly, can include a moveable cam lever housing having one side with an upper shroud cover and a lower shroud cover with a space therebetween and another side having an inwardly facing clamp edge, a lever arm having a pivoting end and an free tip end, the pivoting end being attached within the space between the upper shroud cover and the lower shroud cover, a stationary member having an inner side with an inwardly facing clamp edge, so that the clamp edge on the moveable housing faces the clamp edge on the stationary member, and an elongated member for attaching the moveable housing to the stationary member, wherein rotating the lever arm from an open position to a closed position moves the lever arm to be substantially covered and protected within the upper shroud cover and the lower shroud cover, and wherein the cam lock assembly is adapted to be attached to an accessory in order to attach and detach the accessory by clamping and unclamping the clamp edges to rails attached to another member.

The clamp edge on the moveable housing and the clamp edge on the stationary member can be adapted to clamp about picatinny rails. The pivoting end of the lever arm can be pivotally attached to one end of the elongated member.

The elongated member can include another end with threads for being threadably attached to the stationary member.

Both the upper shroud cover and the lower shroud cover can have outwardly facing generally curved convex perimeter edges. Both of the upper shroud cover and the lower shroud can cover have a rounded outer edge.

The lever arm can have a generally curved convex side and a generally curved concave side, wherein the generally curved convex side fits within the generally curved convex perimeter edges of the upper shroud cover and the lower shroud cover when the lever arm is in a closed position.

The lever arm can be a right hand moving lever arm, and/or the lever arm can be a left hand moving lever arm. The arm can be reversible and work in both directions.

A method of protecting lever arms in cam lever assemblies can include the steps of providing a moveable cam lever housing having one side with an upper shroud cover and a lower shroud cover with a space therebetween and another side having an inwardly facing clamp edge, attaching a pivoting end of a lever arm within the space between the upper shroud cover and the lower shroud cover, providing a stationary member having an inner side with an inwardly facing clamp edge, so that the clamp edge on the moveable housing faces the clamp edge on the stationary member, attaching the moveable housing to the stationary member, and rotating the lever arm from an open position with a free tip end of the lever exposed outside of the space between the upper shroud cover and the lower shroud cover, to a closed position where the lever arm is substantially covered and protected within the upper shroud cover and the lower shroud cover, and wherein the cam lock assembly is adapted to be attached to an accessory in order to attach and detach the accessory by clamping and unclamping the clamp edges to rails attached to another member.

The method can include clamping the clamp edge on the moveable housing and the clamp edge on the stationary member about picatinny rails on the another member.

The method can include pivotally attaching the pivoting end of the lever arm to one end of the elongated member.

The method can include attaching an opposite threaded end of the elongated member to be threadably attached to the stationary member.

The method can include providing each of the upper shroud cover and the lower shroud cover with outwardly facing generally curved convex perimeter edges.

The method can include providing each of the upper shroud cover and the lower shroud cover with a rounded outer edge.

The method can include providing the lever arm a generally curved convex side and a generally curved concave side and fitting the generally curved convex side of the lever arm within the generally curved convex perimeter edges of the upper shroud cover and the lower shroud cover when the lever arm is in a closed position.

The method can include providing the lever arm as a right hand moving lever arm.

The method can include providing the lever arm as a left hand moving lever arm.

Further objects and advantages of this invention will be apparent from the following detailed description of the presently preferred embodiments which are illustrated schematically in the accompanying drawings.

DESCRIPTION OF THE PREFERRED EMBODIMENTS

Before explaining the disclosed embodiments of the present invention in detail it is to be understood that the invention is not limited in its applications to the details of the particular arrangements shown since the invention is capable of other embodiments. Also, the terminology used herein is for the purpose of description and not of limitation.

The components will now be described.

Figure 2:
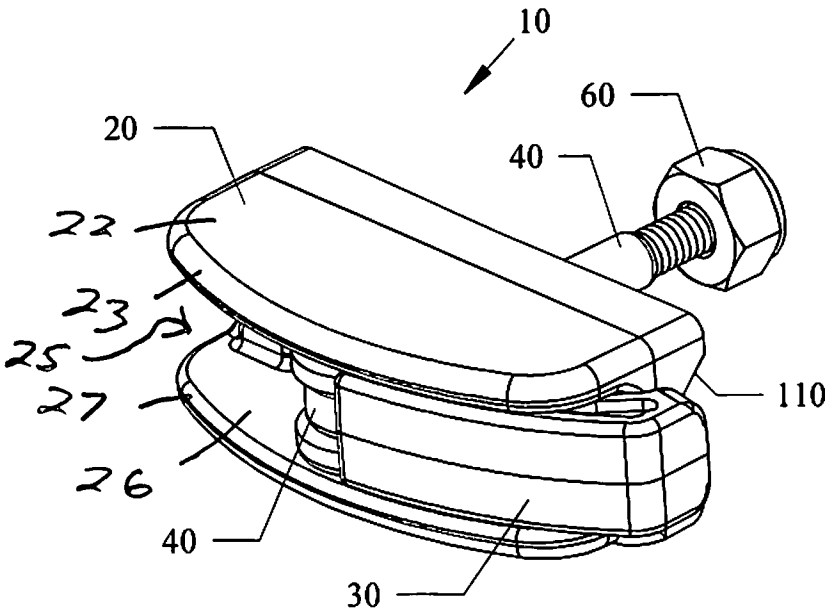
FIG. 2 is a front perspective view of the lock assembly of FIG. 1.
Figure 1:
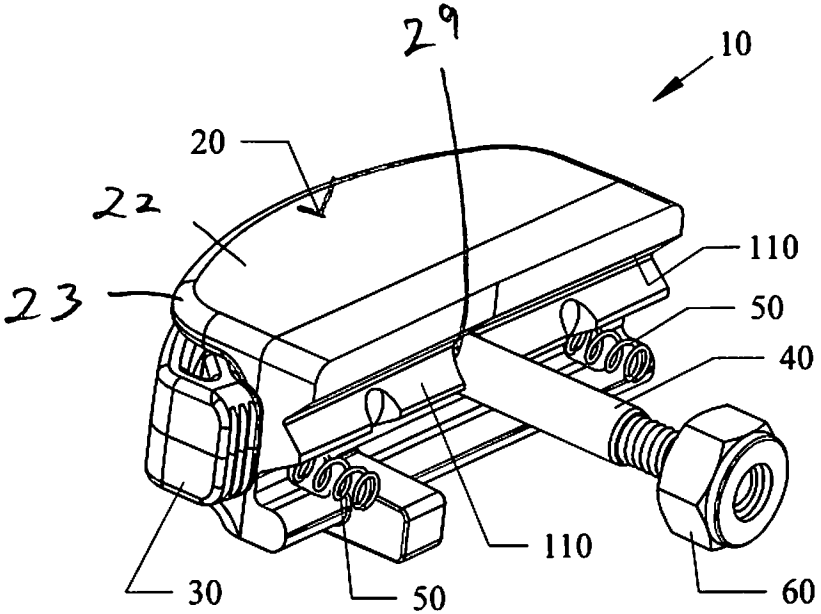
FIG. 1 is a rear perspective view of a right hand cam lock assembly in a clamped position.
Figure 4:
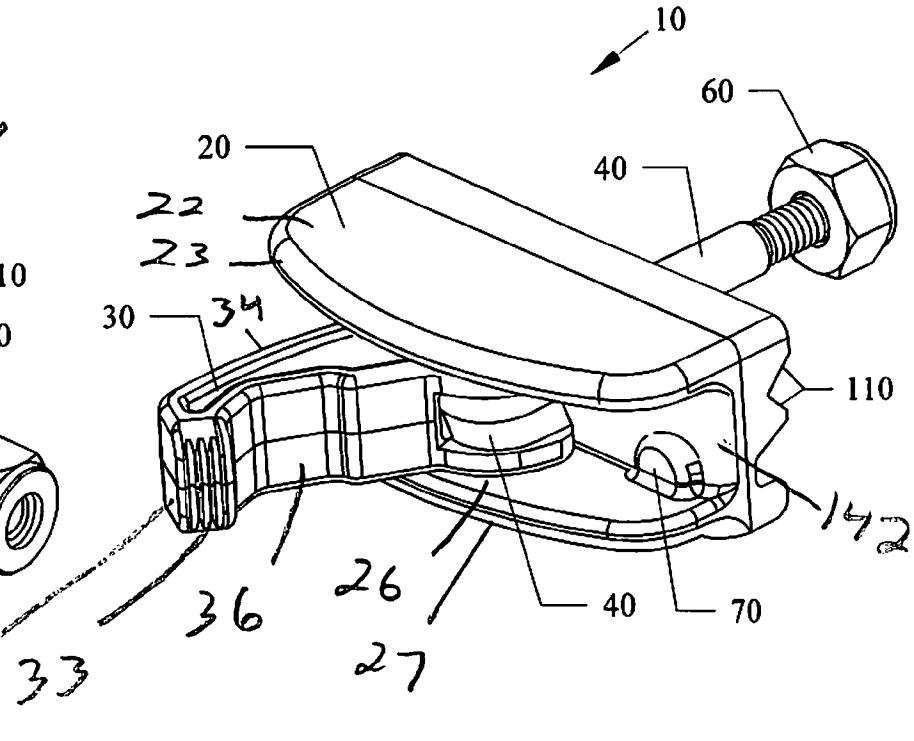
FIG. 4 is a front perspective view of the lock assembly of FIG. 3.
Figure 3:
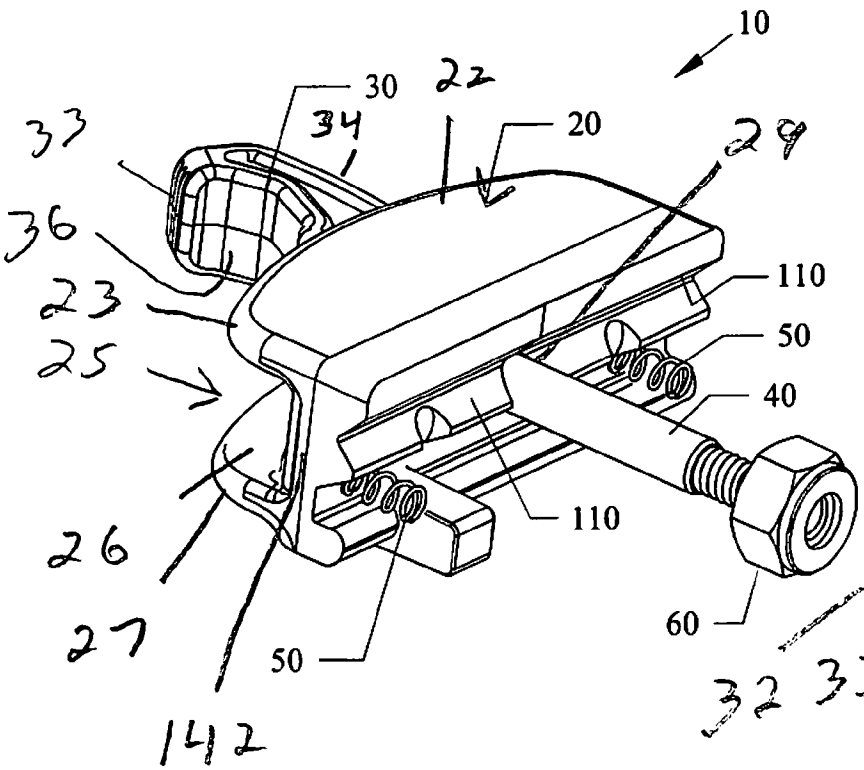
FIG. 3 is a rear perspective view of the lock assembly of FIG. 1 in unclamped position.
Figure 5:
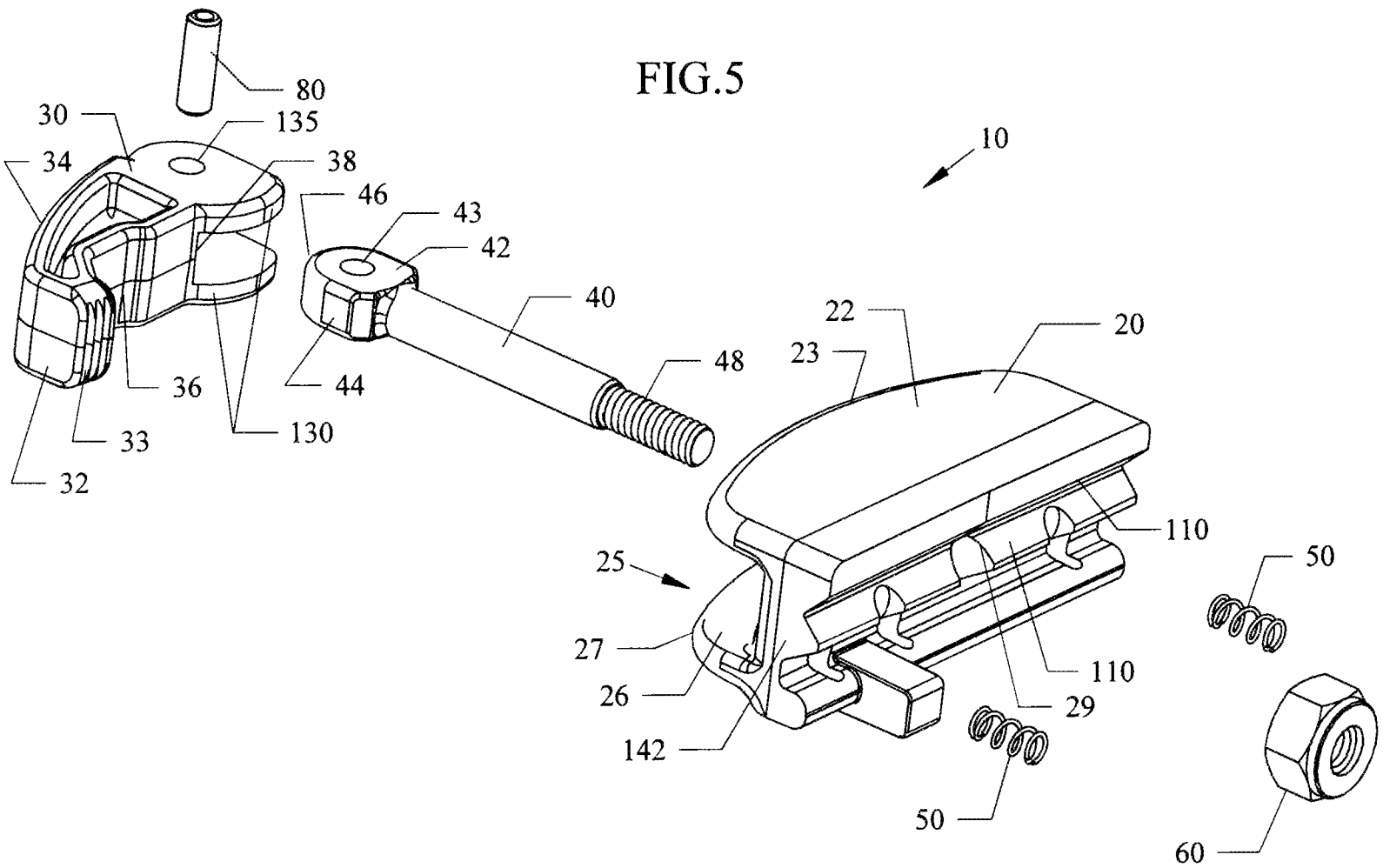
FIG. 5 is a perspective exploded view of the cam lock assembly of the preceding figures.

10 Right hand cam lever assembly.
15 Left hand cam lever assembly.
20 Moveable Mount with Side-lock with cam.
22. Upper shroud cover
23. convex curved perimeter edge with rounded surface
25. space between the upper and lower shroud covers
26. lower shroud cover
27. convex curved perimeter edge with rounded surface
29. through-hole in back of moveable member 20
30 pivotable/foldable cam arm/lever.
32. outer bent tip end
33. raised grip/rib edges
34. convex curved side
36. concave curved side
38. pivoting end
39. concave curved surface
40 Cam pull rod/bolt (elongated member)
42. head end of member
43. through-hole
44. flat sides of the head end
46. rounded outer edge
48. threaded end.
50 Side-lock return spring.
60 Cam pull rod nut.
70 Right cam arm stop.
75 Left cam arm stop.
80 Cam arm pivot pin.
90 Picatinny rail
100 Fore grip.
110 Rail clamping surface of side-lock.
120 Rail clamping surface of stationary mount.
122. stationary member
126. stop member for spring(s) 50
127. through-hole in rail clamping surface for threaded end 48 of rod/bolt 40
130 parallel cam surface plate members
132 enlarged oblong protruding side of plate members
135. through hole
136 generally circular curved outer facing edge of plate members 130
140 Side-lock cam surface (concave curved surface) in back wall 140
142 back wall FIG. 1 is a rear perspective view of a right hand cam lock assembly 10 in a clamped position. FIG. 2 is a front perspective view of the lock assembly 10 of FIG. 1. FIG. 3 is a rear perspective view of the lock assembly 10 of FIG. 1 in unclamped position. FIG. 4 is a front perspective view of the lock assembly 10 of FIG. 3. FIG. 5 is a perspective exploded view of the cam lock assembly 10 of the preceding figures.

Referring to FIGS. 1-5, the cam lock assembly 10 can include a moveable mount (side lock housing with cam) 20 having an upper shroud lid cover 22 with convex curved perimeter edge 23 having a rounded surface, and a lower shroud lid cover 26 convex curved perimeter edge 27 having a rounded surface, with a space 25 formed between the upper shroud cover 22 and the lower shroud cover 26.

A cam arm/lever 30 can have an outer bent tip end 32 with raised grip/ribbed edges. One side of the arm/lever 30 can have a convex curved surface 34 with an opposite side having a concave curved surface 36. A pivoting end 38 of the arm/lever 30 can have parallel cam surface plate members 130 which can fit about a head end 42 of a cam pull rod/bolt (elongated member) 40. The head end 42 can have flat side surfaces 44 with a rounded outer tip surface 46. A cam arm pivot pin 80 can fit in through-holes 135 of cam surface parallel members 130 and through-hole 43 in the head end 42 of the cam pull rod/bolt (elongated member) 40. Pin 80 allows the arm/lever 30 to pivot and rotate relative to the rod/bolt 40. The rod/bolt 40 can pass through a through-hole 29 in the back wall 142 of the moveable member 20. The opposite threaded end 48 of the rod/bolt 40 can be threaded into a cam pull rod nut 60 (which can be attached to a stationary member 122 which will be described in greater detail in reference to FIG. 6.

An inner side of the moveable mount 20 can have inwardly facing rail clamping surface(s) 110 and parallel side-lock return spring(s) 50.

Figure 6:
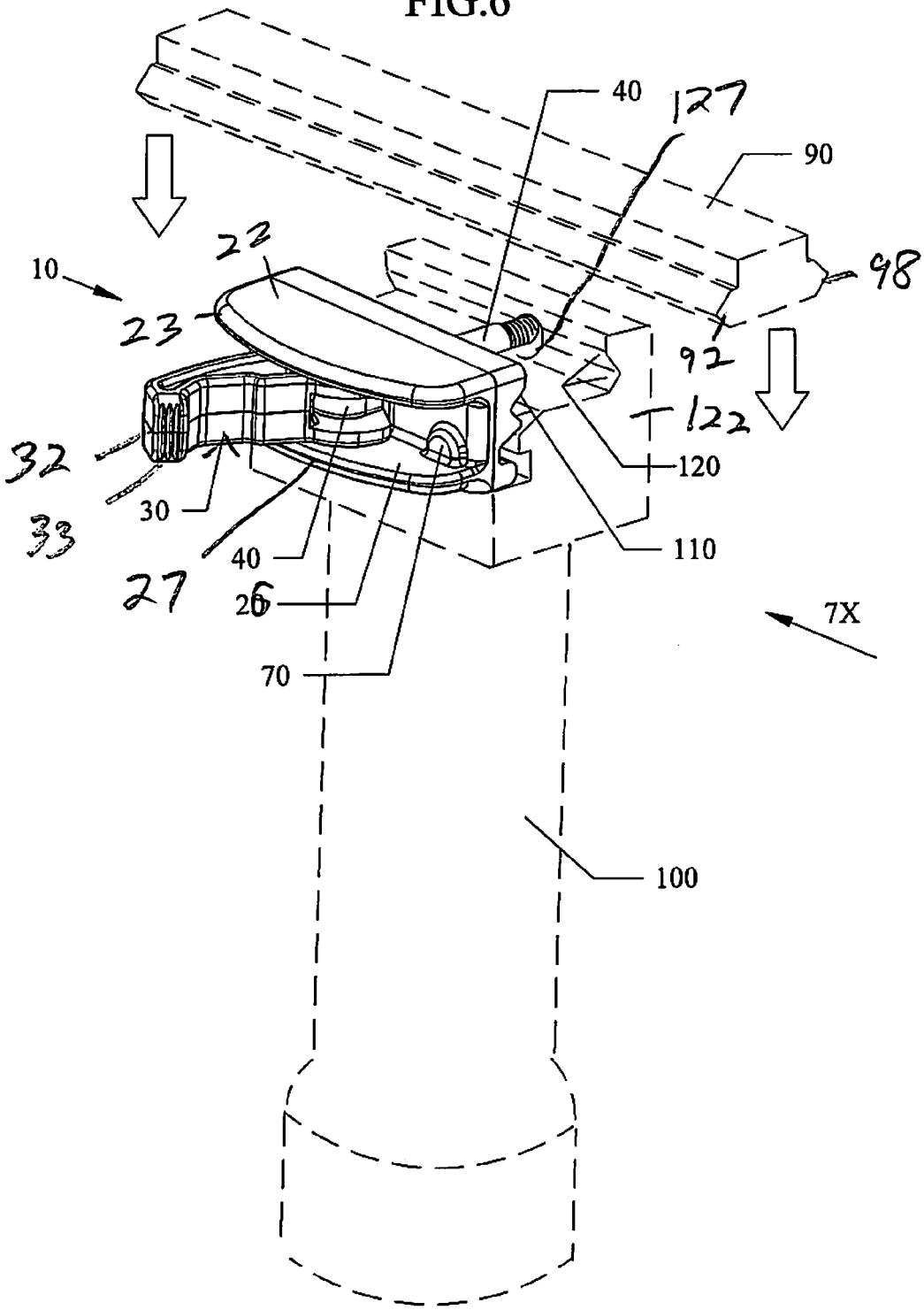
FIG. 6 is a perspective view of the lock assembly of FIG. 1 on a fore grip ready to be attached to a picatinny rail.
Figure 7:
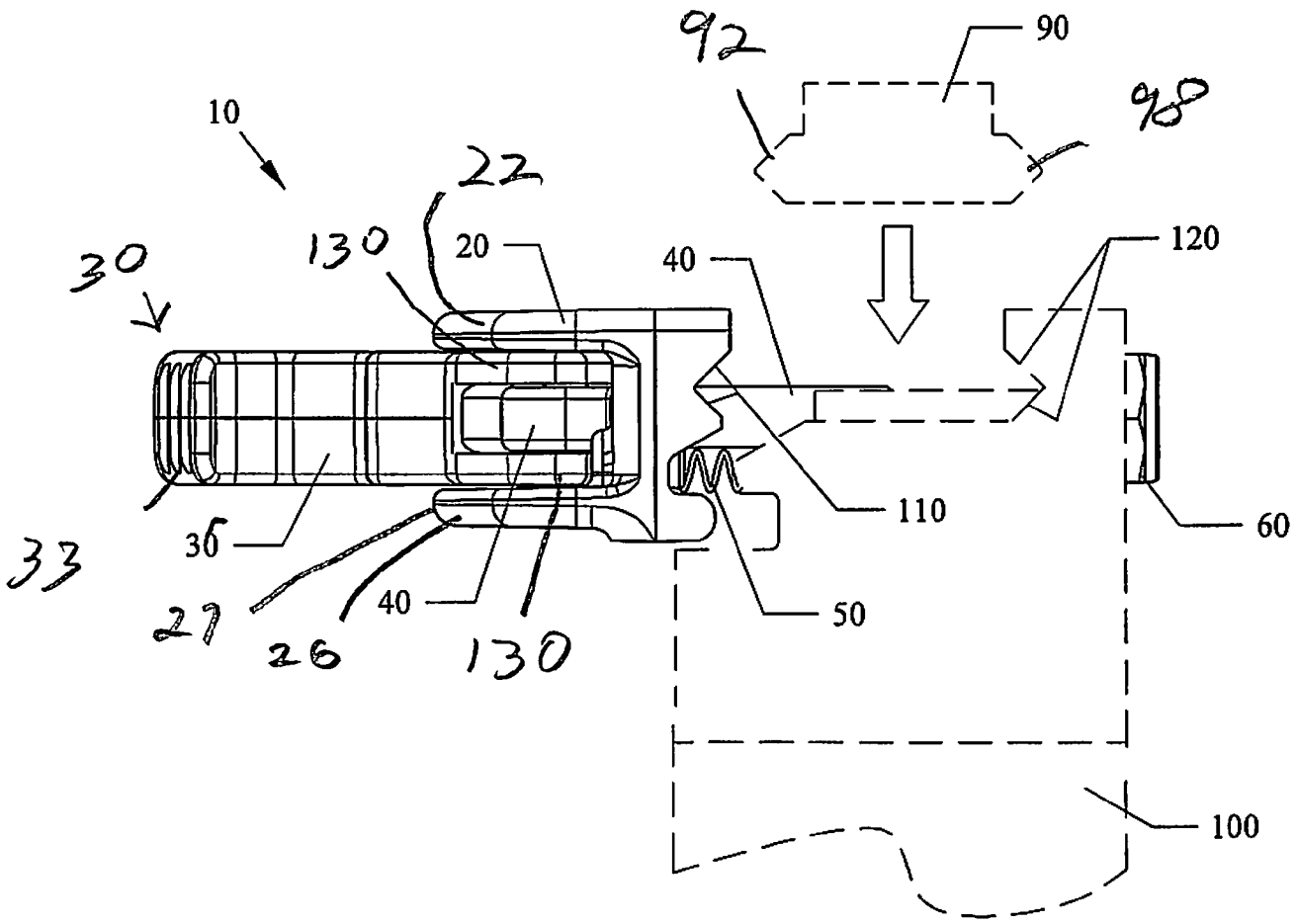
FIG. 7 is a front view of the lock assembly on fore grip with picatinny rail of FIG. 6.
Figure 8:
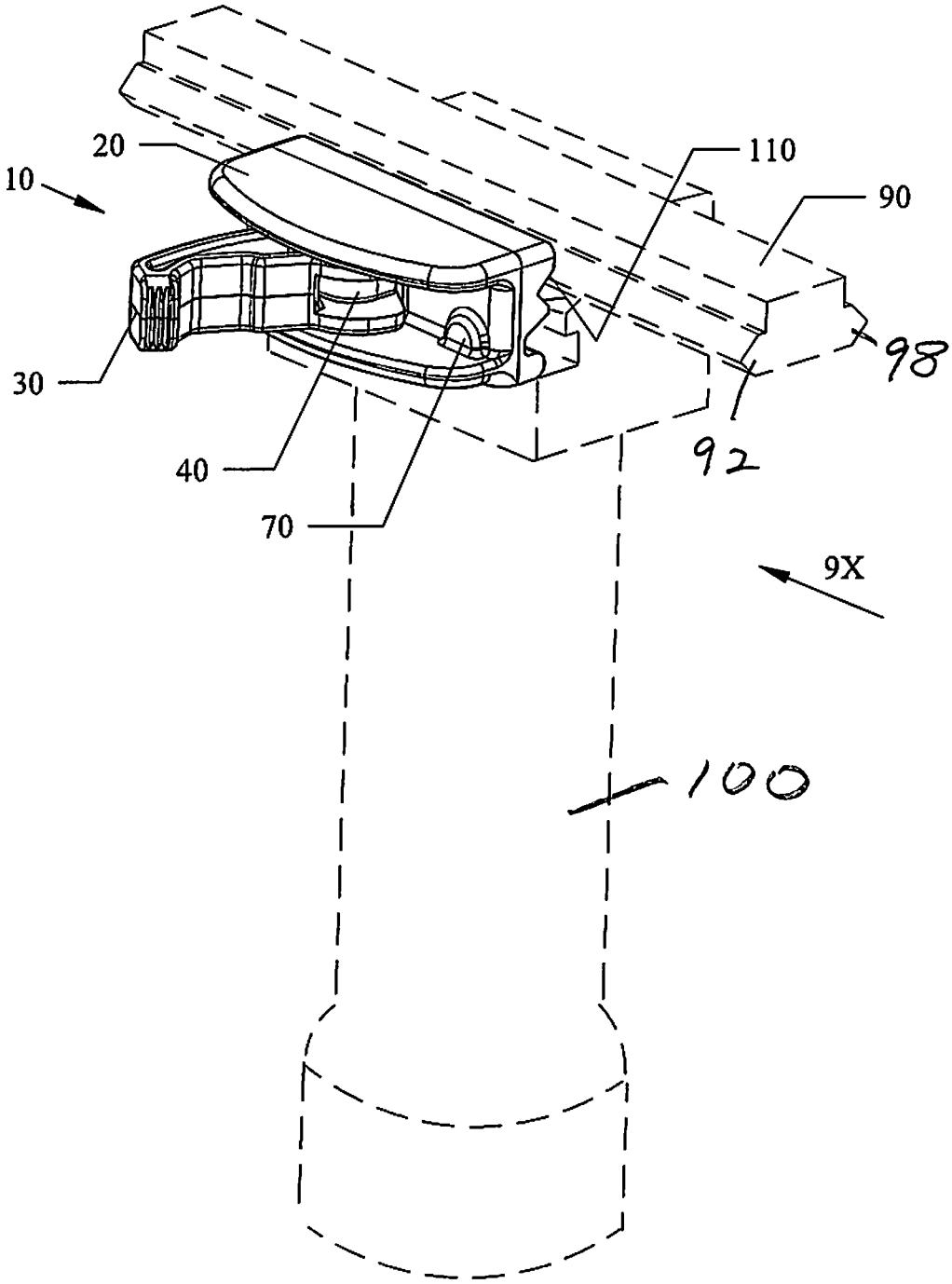
FIG. 8 is a perspective view of the fore grip with lock assembly positioned to be clamped to the picatinny rail of FIG. 6.
Figure 9:
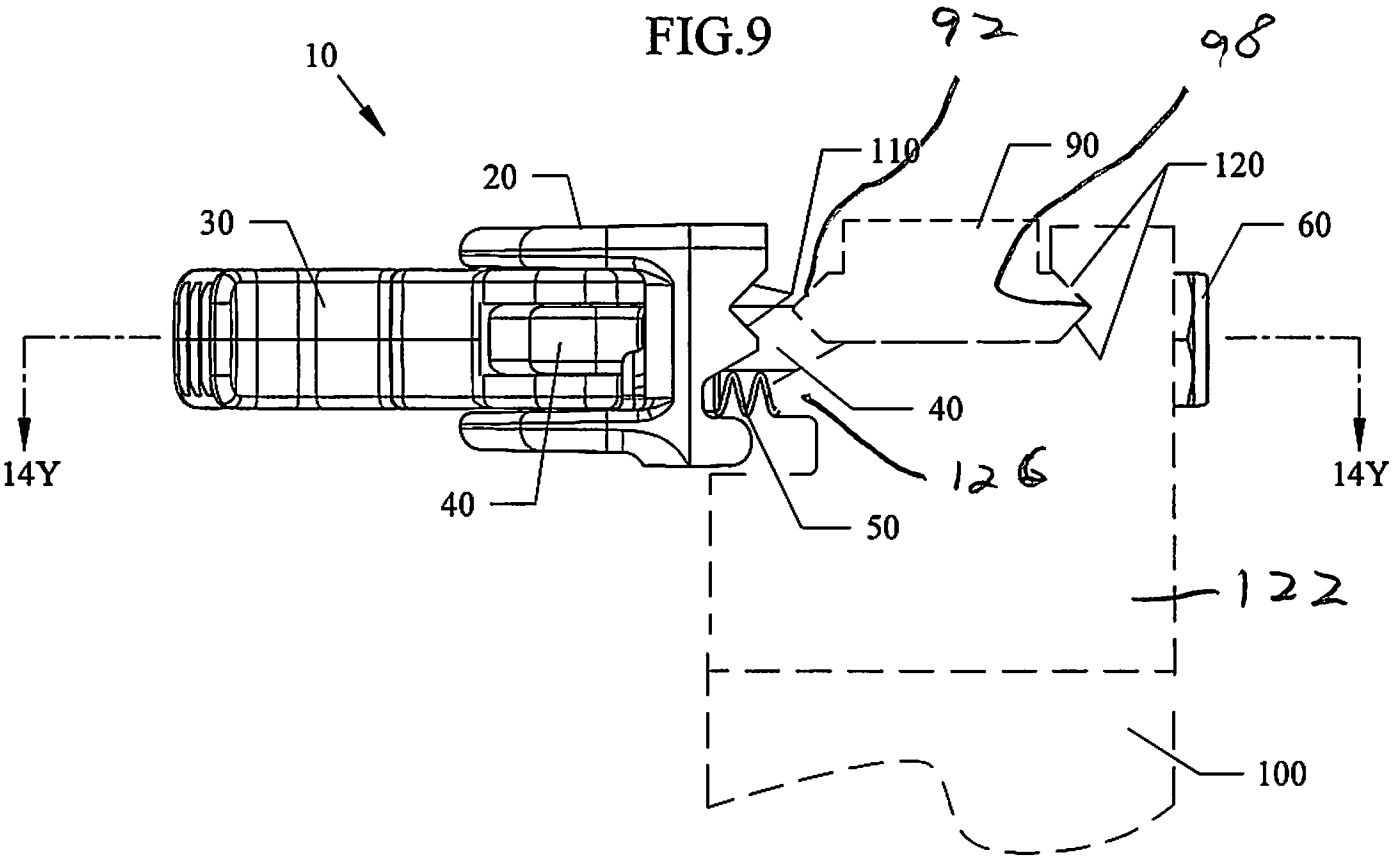
FIG. 9 is a front view of the lock assembly on fore grip with picatinny rail of FIG. 8.

FIG. 6 is a perspective view of the lock assembly 10 of FIG. 1 on a fore grip 100 ready to be attached to a picatinny rail 92 having outward facing rail edges 92, 98. FIG. 7 is a front view of the lock assembly 10 on fore grip 100 with picatinny rail 90 of FIG. 6. FIG. 8 is a perspective view of the fore grip 100 with lock assembly 10 positioned to be clamped to the picatinny rail edges 92, 98 of the picatinny rail 90 of FIG. 6. FIG. 9 is a front view of the lock assembly 10 on fore grip 100 with picatinny rail 90 of FIG. 8.

Figure 14:
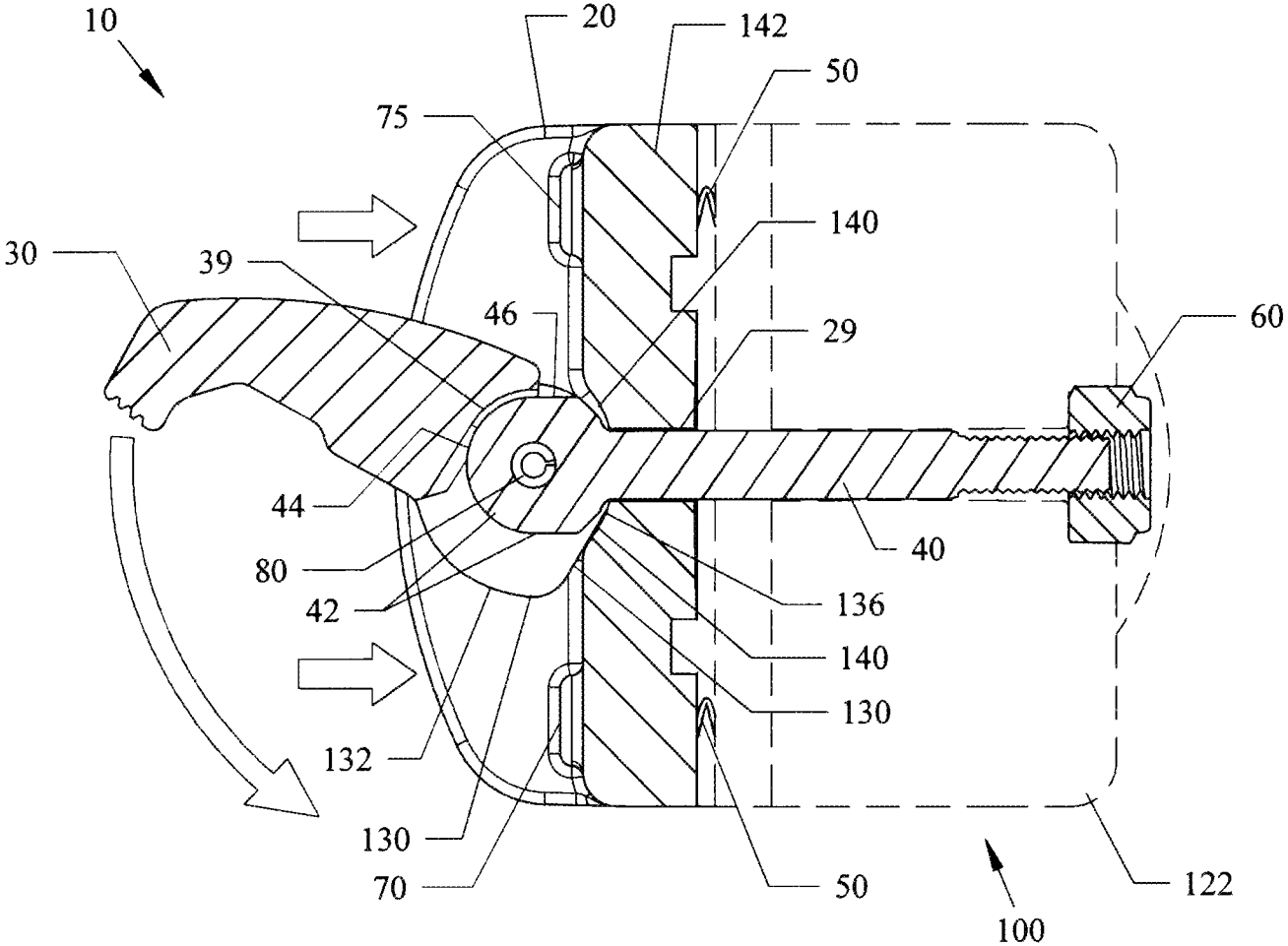
FIG. 14 is a top cross sectional view of the lock assembly on top of fore grip with picatinny rail of FIG. 9 along arrow 14Y.

FIG. 14 is a top cross sectional view of the lock assembly 10 on top of fore grip 100 with picatinny rail of FIG. 9 along arrow 14Y.

Referring to FIGS. 6-9 and 14, the inner face of moveable mount member 20 can include side facing spring(s) 50 that bias against stop member 126 on side of stationary mount 122 that can be attached to or part of a fore grip 100. Clamp portions (clamp edges) 110 on inner side of moveable mount 20 can fit about outwardly facing rail edge 92 of picatinny rail 90. Opposite facing rail edge 98 on picatinny rail 90 can fit into clamp portions (clamp edges) 120 on stationary mount 122. A through-hole 127 in rail clamping surface 120 can receive the threaded end 48 of rod/bolt 40, with the nut 60 located on the outside of stationary mount 122. As shown in these figures, the open position of arm/lever 30 allows for the moveable mount 20 to be spaced away from stationary mount 120 allowing for the picatinny rail 90 to be inserted between the moveable mount 20 and rail clamping surface 120 of the stationary mount 122. The concave curved surface 39 of the pivoting end 38 of the arm/lever 30 slides about the flat side 46 and rounded end 44 of the rod/bolt 40. The generally circular curved edge 136 of the parallel plates of the cam surface 130 can slide against the mateingly curved concave side-lock surface on the back wall 142 of the moveable mount 40.

Figure 10:
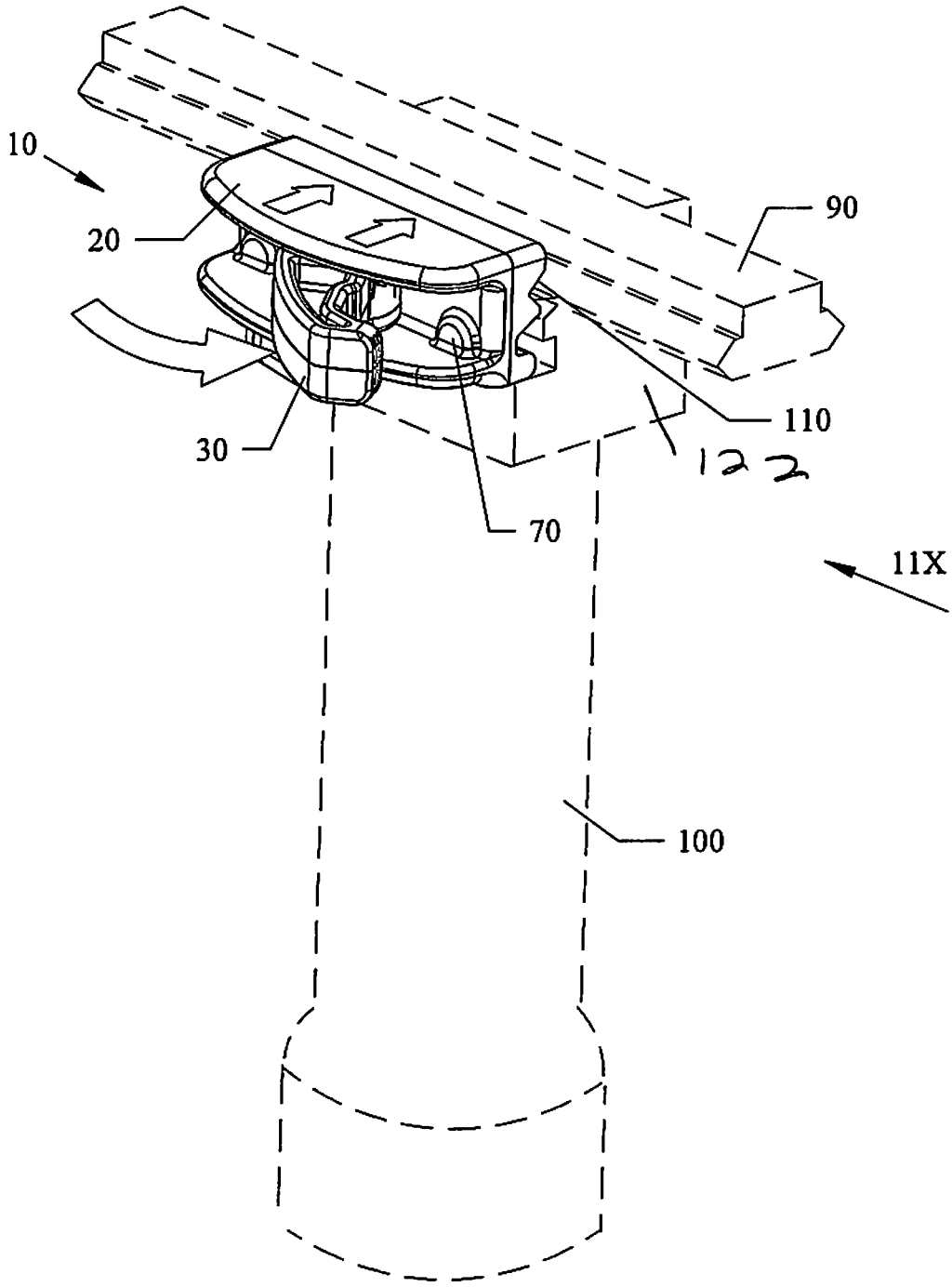
FIG. 10 is a perspective view of FIG. 8 with cam arm/lever rotated toward cam arm stop resulting in the side-lock cam (moveable mount) moving toward the picatinny rail.
Figure 11:
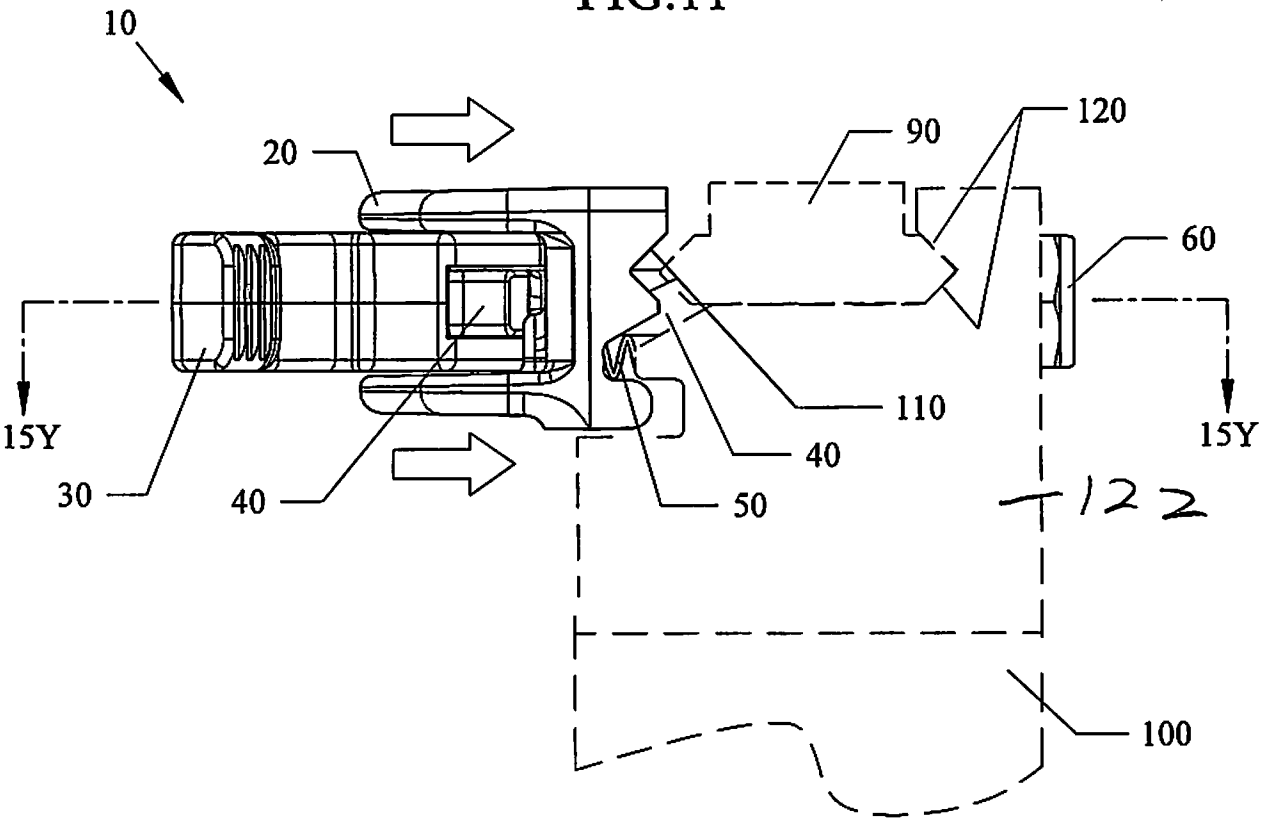
FIG. 11 is a front view of the lock assembly on fore grip with picatinny rail of FIG. 10.

FIG. 10 is a perspective view of FIG. 8 with cam arm/lever 30 rotated in a right hand direction toward cam arm stop 70 resulting in the side-lock cam (moveable mount) 20 moving toward the picatinny rail 90. FIG. 11 is a front view of the lock assembly 10 on fore grip 100 with picatinny rail 90 of FIG. 10.

Figure 15:
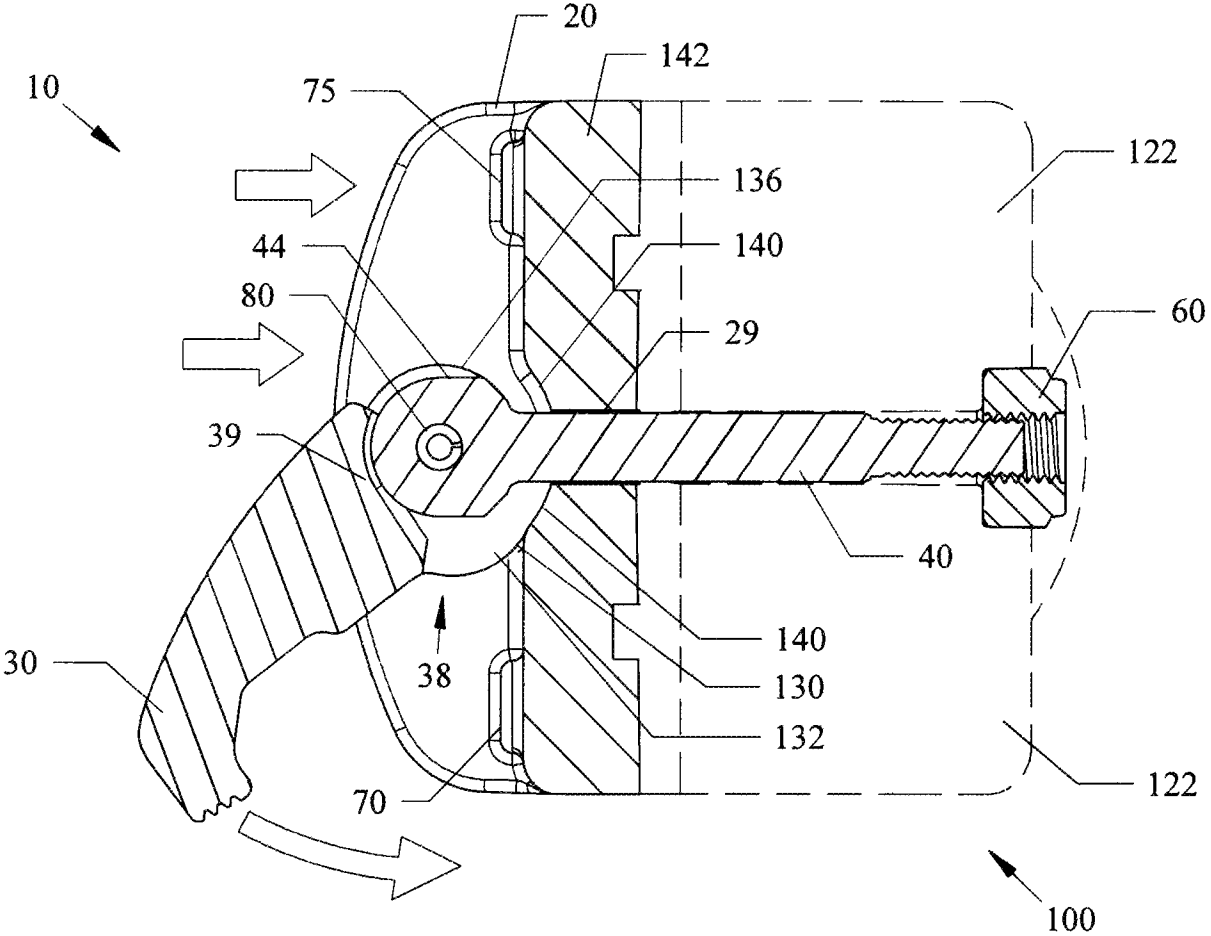
FIG. 15 is a top cross sectional view of the lock assembly on top of the fore grip with picatinny rail of FIG. 11 along arrow 15Y.

FIG. 15 is a top cross sectional view of the lock assembly 10 on top of the fore grip 100 with picatinny rail 90 of FIG. 11 along arrow 15Y.

Referring to FIGS. 10, 11 and 15 rotating the arm/lever 30 in a right hand direction allows for the concave curved surface 39 on pivoting end 38 of the arm/lever 30 to slide about rounded outer edge 46 of head end 42 of rod/bolt 40. As the arm/lever 30 starts to rotate the generally circular outer surface edges of the cam surface plate members 130 rotate out of the concave curved side-lock cam surface 140. The enlarged oblong protruding side edge 132 of cam surface plate members 130 start rotating into and against the concave curved cam surface 140 of the back wall 142 which results in pushing against the back wall 142 so the moveable mount 20 starts moving inward toward stationary mount 122.

Figure 12:
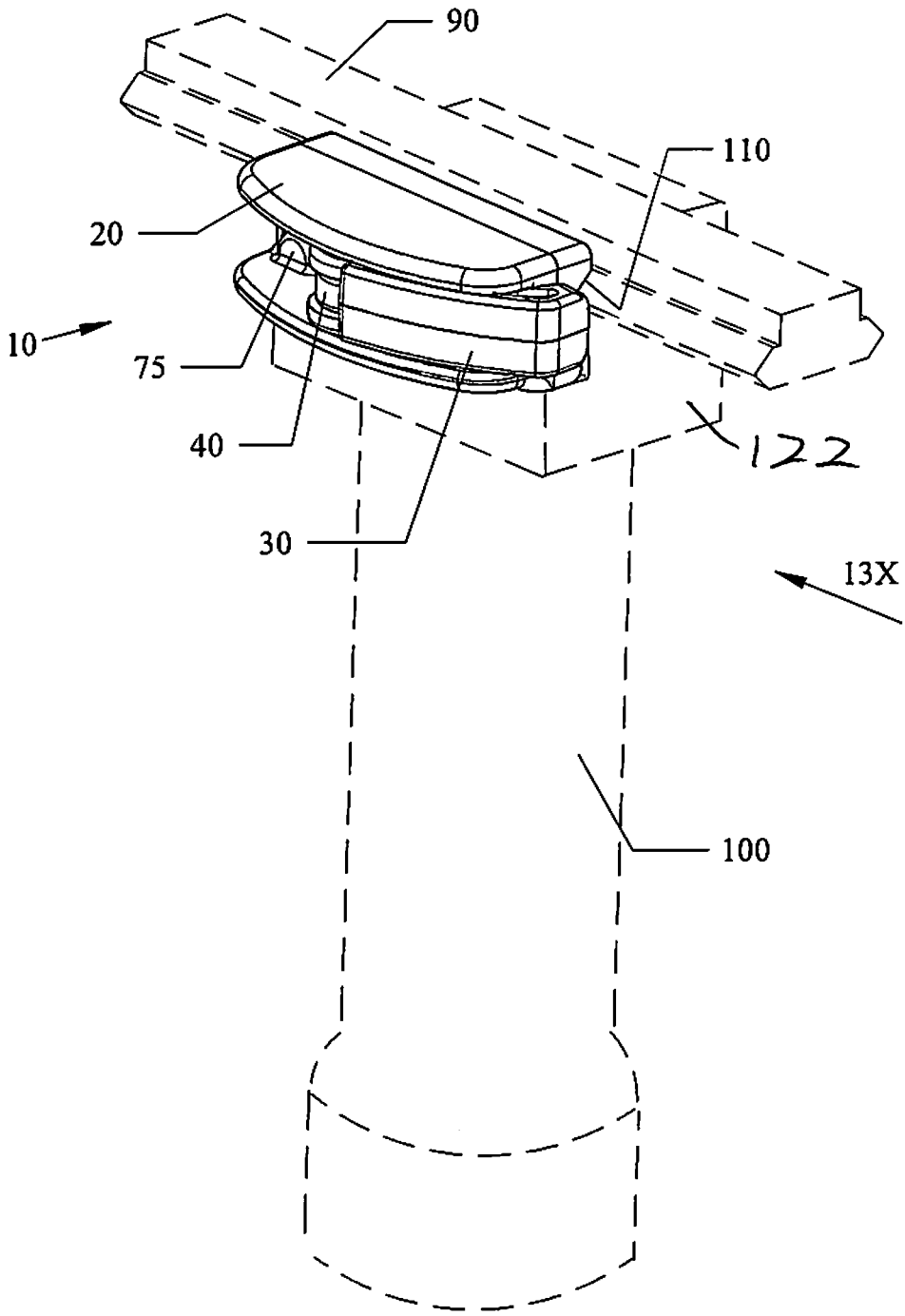
FIG. 12 is a perspective view of FIG. 10 with cam arm/lever rotated fully against stop resulting in the side-lock cam (moveable mount) securely clamped to the picatinny rail.
Figure 13:
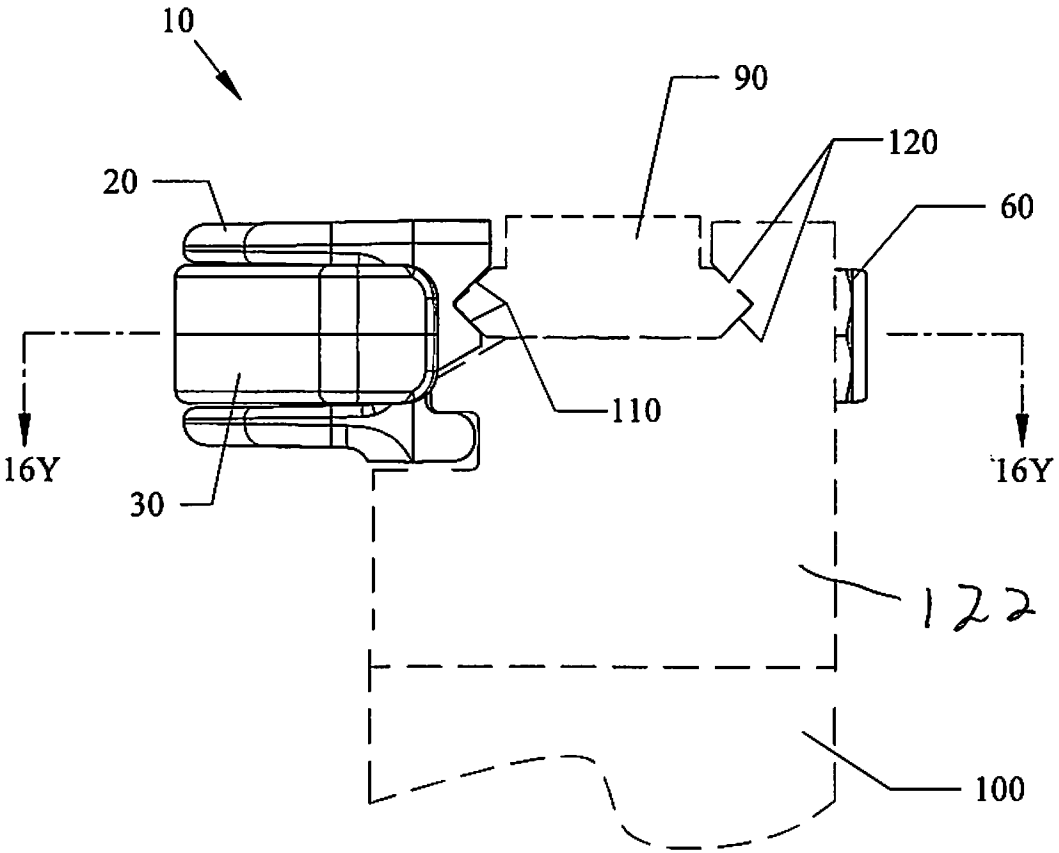
FIG. 13 is a front view of the lock assembly on fore grip with picatinny rail of FIG. 12.

FIG. 12 is a perspective view of FIG. 10 with cam arm/lever 30 rotated fully against cam arm stop 70 resulting in the side-lock cam (moveable mount) 20 securely clamping against the picatinny rail 90. FIG. 13 is a front view of the lock assembly 10 on top of the fore grip 100 with picatinny rail of FIG. 12.

Figure 16:
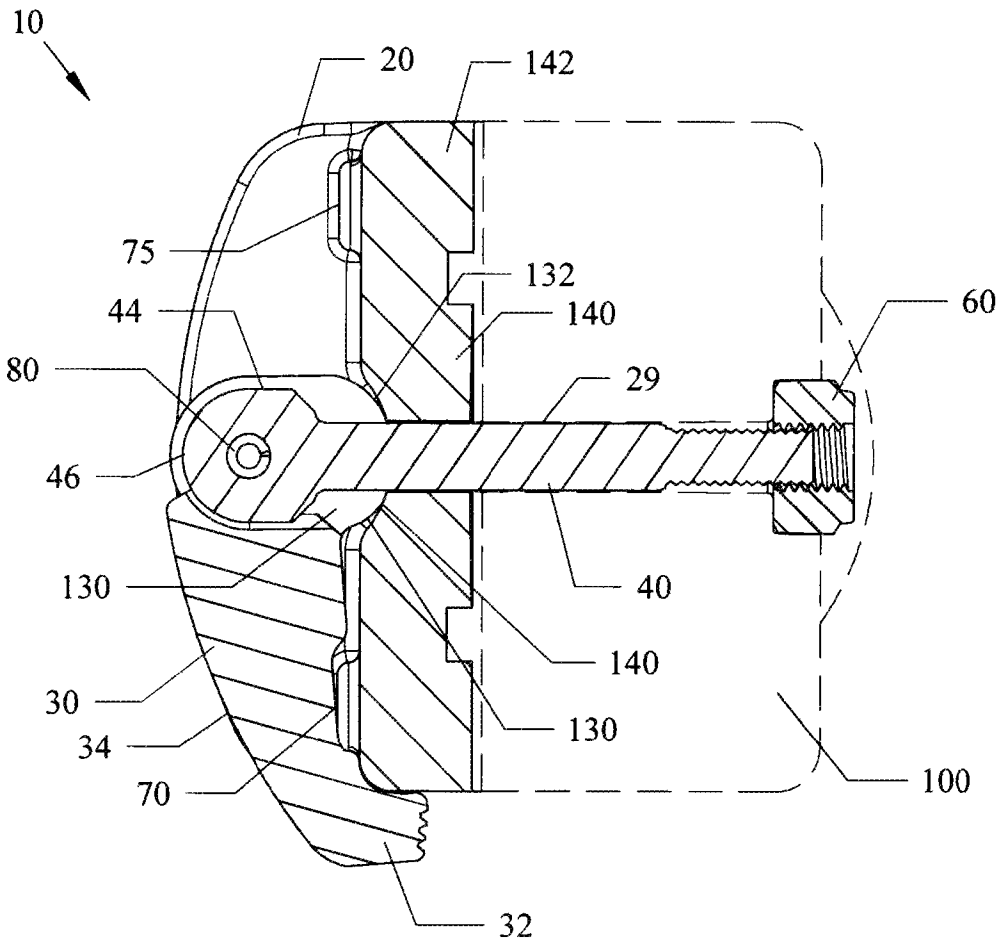
FIG. 16 is a top cross-sectional view of the lock assembly on fore grip with picatinny rail of FIG. 13 along arrow 16Y.

FIG. 16 is a top cross-sectional view of the lock assembly 10 on top of fore grip 100 with picatinny rail of FIG. 13 along arrow 16Y.

Referring to FIGS. 12, 13 and 16, the arm/lever 30 is fully rotated to a closed position against right cam stop 70 so that substantially most of the arm/lever 30 is located within the space 25 formed between the upper shroud lid cover 22 and lower shroud lid cover 26, and where the convex curved side 34 of arm/lever 30 is parallel and generally flush with convex curved perimeter edge 23, 27 of the upper shroud lid cover 22 and lower shroud lid cover 26. As shown the bent tip end is wrapped about back wall 142 of the moveable mount 20.

In the fully rotated position, the enlarged oblong protruding side 132 of plate members 130 is pushing against concave curved cam surface 140 of the back wall 140 causing rail clamping surface 110 of the inner side of moveable mount 20 to be pushed against and clamped outer rail edge 92 of the picatinny rail 90.

Figure 17:
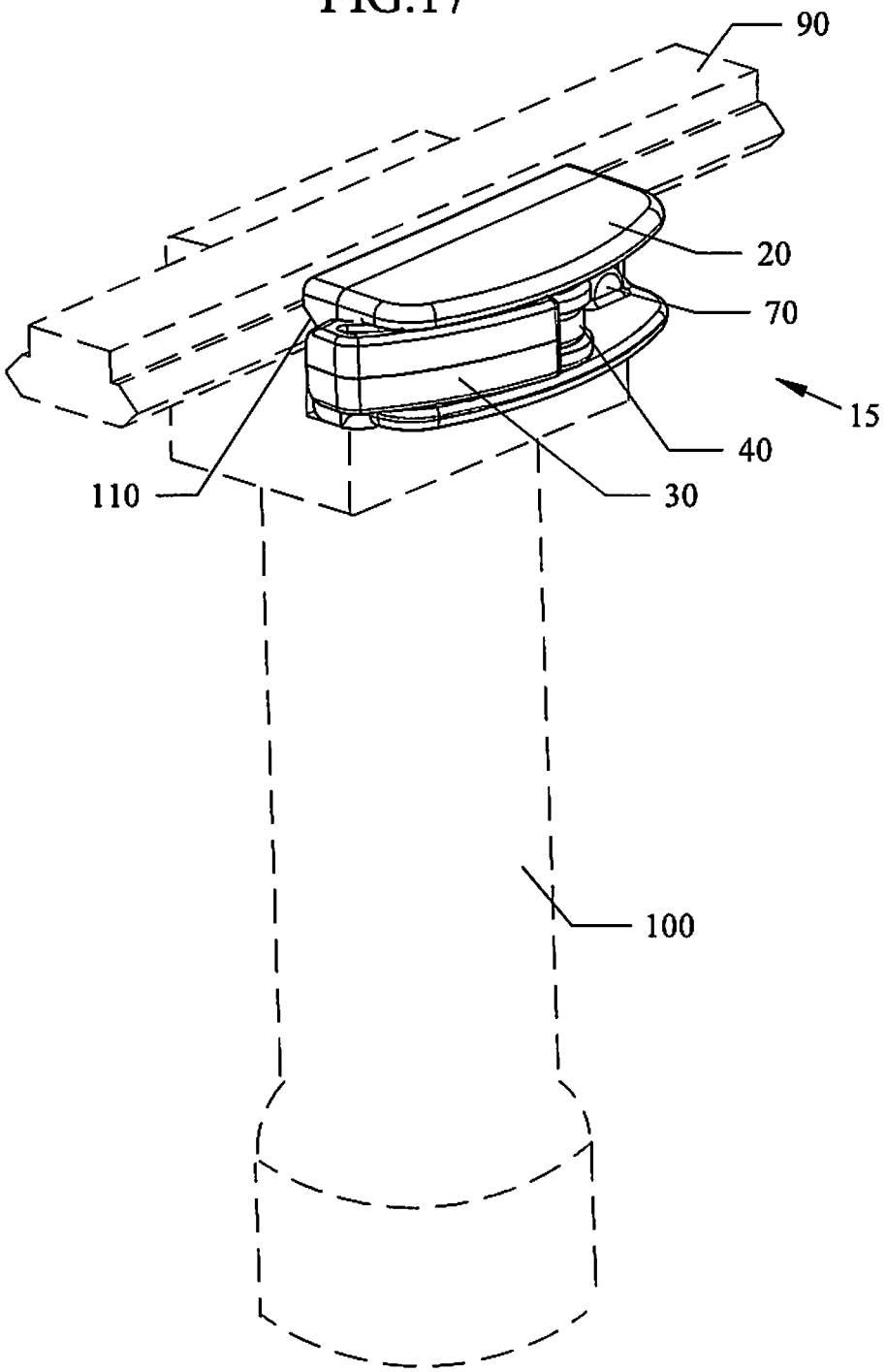
FIG. 17 is a perspective view of a left hand cam lock assembly on a to fore grip attached to a picatinny rail.

FIG. 17 is a perspective view of a left hand cam lock assembly 15 on top of fore grip 100 attached to a picatinny rail 90. Referring to FIGS. 16, 17, this lock assembly can have a left hand rotated arm/lever 30 that works in the reverse direction to the right handed lock assembly 10 previously described. The left hand lock assembly 15 can have a similar open position with the arm/lever 30 generally perpendicular to the moveable mount 20 and can rotate in a left hand direction where the arm/lever 30 moves to a closed position similarly moving the moveable mount 20 toward the stationary mount 122 where a left handed stop 75 is used to stop the arm/lever 30 in the fully closed position.

The right handed lock assembly 10 and left handed lock assembly 15 can have the moveable member 20 separate and move away from the stationary mount 122 by rotating the arm/lever 30 in an opposite direction.

While the right hand lock assembly 10 and left hand lock assembly 15 are shown as being mounted to a top of a fore grip, the assemblies can be part of other accessories, such as but not limited to sights, flashlights, and any other accessories that can be mounted and attached to picatinny rails on firearms.

The novel invention has a pivotable/foldable arm that when rotated to a closed position has a low profile, which is shrouded and protected within an upper and lower lid cover type housing. The lid covers on the housing protects the arm/lever from damage and protects the arm/lever from inadvertent release that is a problem with prior art arm/levers.

The outer perimeter edges of the upper and lower lid covers have curved sidewalls that aid in the non protruding nature of the invention. The curved shape of the cam arm/levers can have an ergonomic shape designed to not stick out and protrude outward.

The arms/levers in the assemblies can be reversible and work in opposite 180 degree directions where the arms/levers are shrouded in both positions. The pivotable/foldable arms/levers can lock in both the fully forward and fully reverse directions.

In the fully closed positions, the arms/levers clamp in forward direction where the cam surface plate members 130 with oblong side edges 132 cause an eccentric lever action to hold the arms/levers 30 in place.

The right handed cam lock assembly 10 and left handed cam lock assembly 15 allow for fast attach and fast detach action where the closed positions allow for shrouding the sides of the lever so that the arms/levers do not snag and there is no accidental release of the closed arms/levers.

The novel right hand cam lever assembly 10 and left hand cam lever assembly 15 offer and inexpensive solution to non snag problems of the prior art without requiring extra parts such as extra buttons, extra levers, etc.

The novel right hand cam lever assembly 10 and left hand cam lever assembly 15 can be entirely formed from injection molded polymer and not require metal, and the like. Unlike most prior art arms/levers, the novel cam lever assemblies do not require machined metal and cast metal.

Alternatively, the novel right hand cam lever assembly 10 and left hand cam lever assembly 15 can be formed from other materials such as metal, and combinations of material such as metal and plastic and the like.

Although the invention is described in reference to the drawings as being used for firearms, the invention can be used in other applications, such as in photography for attaching stands to cameras, and the like, as well as other applications.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. A cam lock assembly, comprising:

a moveable cam lever housing having one side with an upper shroud cover having a continuously curved perimeter and a lower shroud cover having a continuously curved perimeter, with a space therebetween and another side having an inwardly facing clamp edge;

a lever arm having a pivoting end and a free tip end with an elongated arm portion between the pivoting end and the free tip end, the pivoting end being attached within the space between the upper shroud cover and the lower shroud cover, the elongated arm portion having a similar curved perimeter to the continuously curved perimeter on the upper shroud and the continuously curved perimeter on the lower shroud;

a stationary member having an inner side with an inwardly facing clamp edge, so that the clamp edge on the moveable housing faces the clamp edge on the stationary member; and an elongated member for attaching the moveable housing to the stationary member, wherein rotating the lever arm from an open position to a closed position moves the lever arm so that the elongated arm portion is covered and protected by each of the upper shroud cover and the lower shroud cover, and wherein the cam lock assembly is adapted to be attached to an accessory in order to attach and detach the accessory by clamping and unclamping the clamp edges to mounting rails attached to a firearm.

2. The cam lock assembly of claim 1, wherein the clamp edge on the moveable housing and the clamp edge on the stationary member are adapted to clamp about picatinny rails.

3. The cam lock assembly of claim 1, wherein the pivoting end of the lever arm is pivotally attached to one end of the elongated member.

4. The cam lock assembly of claim 3, wherein the elongated member includes:

another end with threads for being threadably attached to the stationary member.

5. The cam lock assembly of claim 1, wherein each of the upper shroud cover and the lower shroud cover have outwardly facing generally curved convex perimeter edges.

6. The cam lock assembly of claim 5, wherein each of the upper shroud cover and the lower shroud cover have a rounded outer edge.

7. The cam lock assembly of claim 5, wherein the lever arm includes:

a generally curved convex side; and a generally curved concave side, wherein the generally curved convex side fits within the generally curved convex perimeter edges of the upper shroud cover and the lower shroud cover when the lever arm is in a closed position.

8. The cam lock assembly of claim 1, wherein the lever arm is a right hand moving lever arm.

9. The cam lock assembly of claim 1, wherein the lever arm is a left hand moving lever arm.

10. A method of protecting lever arms in cam lever assemblies comprising the steps of:

providing a moveable cam lever housing having one side with an upper shroud cover having a continuously curved perimeter and a lower shroud cover having a continuously curved perimeter, with a space therebetween and another side having an inwardly facing clamp edge;

providing a lever arm having a pivoting end and a free tip end with an elongated arm portion between the pivoting end and the free tip end, the elongated arm portion having a similar curved perimeter to the continuously curved perimeter on the upper shroud and the continuously curved perimeter on the lower shroud;

attaching the pivoting end of the lever arm within the space between the upper shroud cover and the lower shroud cover;

providing a stationary member having an inner side with an inwardly facing clamp edge, so that the clamp edge on the moveable housing faces the clamp edge on the stationary member; and attaching the moveable housing to the stationary member; and rotating the lever arm from an open position with a free tip end of the elongated lever arm portion with free tip end exposed outside of the space between the upper shroud cover and the lower shroud cover, to a closed position where the elongated lever arm portion is covered and protected within each of the upper shroud cover and the lower shroud cover, and wherein the cam lock assembly is adapted to be attached to an accessory in order to attach and detach the accessory by clamping and unclamping the clamp edges to mounting rails attached to a firearm.

11. The method of claim 10, further comprising the step of:

clamping the clamp edge on the moveable housing and the clamp edge on the stationary member about picatinny rails on the another member.

12. The method of claim 10, further comprising the step of:

pivotally attaching the pivoting end of the lever arm to one end of the elongated member.

13. The method of claim 12, further comprising the step of:

attaching an opposite threaded end of the elongated member to be threadably attached to the stationary member.

14. The method of claim 10, further comprising the step of:

providing each of the upper shroud cover and the lower shroud cover with outwardly facing generally curved convex perimeter edges.

15. The method of claim 14, further comprising the step of:

providing each of the upper shroud cover and the lower shroud cover with a rounded outer edge.

16. The method of claim 10, further comprising the steps of:

providing the lever arm a generally curved convex side and a generally curved concave side; and fitting the generally curved convex side of the lever arm within the generally curved convex perimeter edges of the upper shroud cover and the lower shroud cover when the lever arm is in a closed position.

17. The method of claim 10, further comprising the step of:

providing the lever arm as a right hand moving lever arm.

18. The method of claim 10, further comprising the step of:

providing the lever arm as a left hand moving lever arm.

19. A cam lock assembly, comprising:

a first cam lever housing having one side with an upper shroud cover having a continuously curved perimeter and a lower shroud cover having a continuously curved perimeter, with a space therebetween and another side having an inwardly facing clamp edge;

a lever arm having a pivoting end and a free tip end with an elongated arm portion between the pivoting end and the free tip end, the pivoting end being attached within the space between the upper shroud cover and the lower shroud cover, the elongated arm portion having a similar curved perimeter to the continuously curved perimeter on the upper shroud and the continuously curved perimeter on the lower shroud;

a cam member having an inner side with an inwardly facing clamp edge, so that the clamp edge on the housing faces the clamp edge on the cam member; and an elongated member for attaching the housing to the cam member, wherein rotating the lever arm from an open position to a closed position moves the lever arm so that the elongated arm portion is covered and protected by each of the upper shroud cover and the lower shroud cover, and wherein the cam lock assembly is adapted to be attached to an accessory in order to attach and detach the accessory by clamping and unclamping the clamp edges to mounting rails attached to a firearm.

* * * * *